US007628162B2

(12) United States Patent
Shin

(10) Patent No.: US 7,628,162 B2
(45) Date of Patent: Dec. 8, 2009

(54) DISH WASHER AND BLOWER COVER THEREOF

(75) Inventor: Kap Soo Shin, Cheongjoo-si (KR)

(73) Assignee: LG Electronics Inc., Seoul (KR)

( * ) Notice: Subject to any disclaimer, the term of this patent is extended or adjusted under 35 U.S.C. 154(b) by 641 days.

(21) Appl. No.: 10/574,538

(22) PCT Filed: Aug. 9, 2005

(86) PCT No.: PCT/KR2005/002586

§ 371 (c)(1),
(2), (4) Date: Apr. 3, 2006

(87) PCT Pub. No.: WO2006/019230

PCT Pub. Date: Feb. 23, 2006

(65) Prior Publication Data

US 2007/0068561 A1 Mar. 29, 2007

(30) Foreign Application Priority Data

Aug. 16, 2004 (KR) ..... 10-2004-0064197

(51) Int. Cl.
*B08B 3/02* (2006.01)

(52) U.S. Cl. ..... 134/95.2; 134/200

(58) Field of Classification Search ..... 134/184, 134/198, 95.2, 200; D32/382, 421; 416/247 R; 454/273

See application file for complete search history.

(56) References Cited

U.S. PATENT DOCUMENTS 3,680,940 A * 8/1972 Johansson et al. ..... 312/213
4,179,821 A * 12/1979 Herbst et al. ..... 34/235
4,184,500 A * 1/1980 Herbst ..... 134/114
4,247,158 A * 1/1981 Quayle ..... 312/213
4,487,117 A 12/1984 Colley et al.
4,657,036 A * 4/1987 Yake ..... 134/95.2
4,709,488 A * 12/1987 Anselmino et al. ..... 34/235
5,744,213 A 4/1998 Nelson
5,859,952 A 1/1999 Levine et al.
6,349,731 B1 * 2/2002 Schaaf et al. ..... 134/114
6,427,984 B1 8/2002 Mulvaney et al.
7,216,654 B2 * 5/2007 Kang ..... 134/58 DL
7,367,134 B2 * 5/2008 Osvatic et al. ..... 34/62

FOREIGN PATENT DOCUMENTS

CH 683819 * 5/1994
JP 07-163507 * 6/1995
JP 10-306933 * 11/1998
JP 11-276415 * 10/1999

(Continued)

OTHER PUBLICATIONS

European Patent Office 0 556 773 Aug. 1993.*

(Continued)

*Primary Examiner*—Frankie L Stinson
(74) *Attorney, Agent, or Firm*—McKenna Long & Aldridge LLP

(57) ABSTRACT

A blower cover assembly of a dishwasher includes an attaching cap contacting a door liner, a guide sleeve extending frontward from the attaching cap, and a guide rib formed on an inner circumference to guide flow of washing water.

6 Claims, 3 Drawing Sheets

FOREIGN PATENT DOCUMENTS

| | | | |
|---|---|---|---|
| JP | 11-346981 | * | 12/1999 |
| JP | 2002-253469 | * | 9/2002 |
| JP | 2002-282193 | * | 10/2002 |
| JP | 2002-301001 | * | 10/2002 |
| KR | 1997-353 A | | 1/1997 |

OTHER PUBLICATIONS

European Patent Office 0 793 940 Sep. 1997.*
Europena Patent Office 1 127 532 Aug. 2001.*
International Search Report dated Nov. 17, 2005.

* cited by examiner

[Fig. 1]
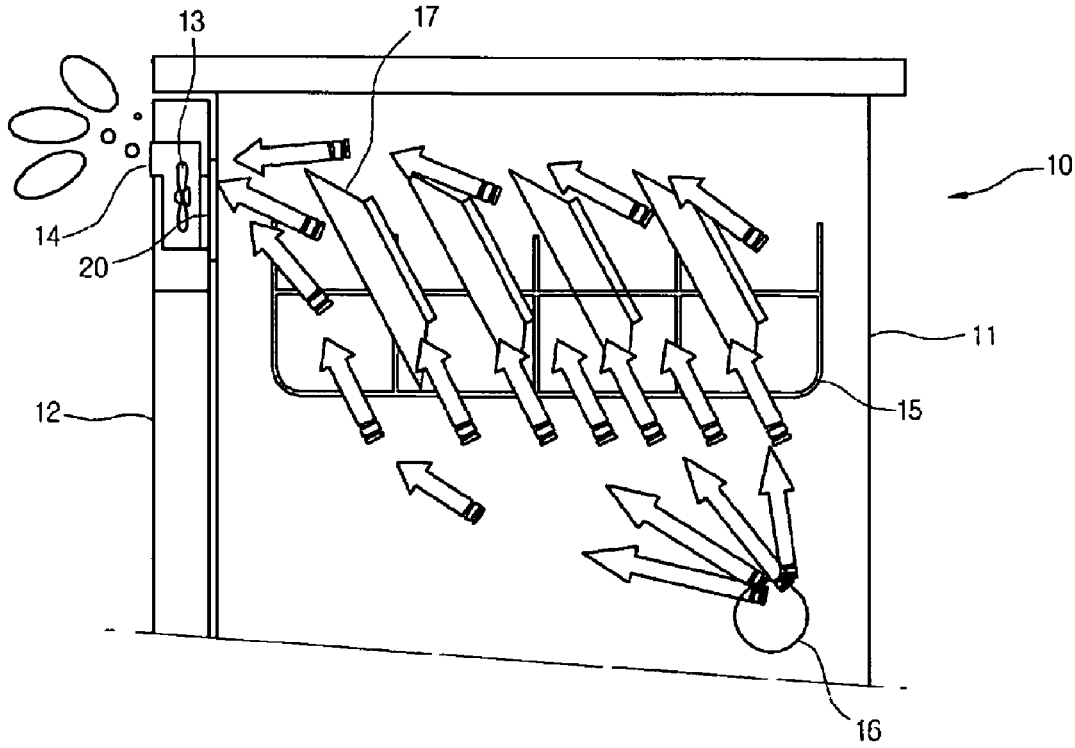
[Fig. 2]
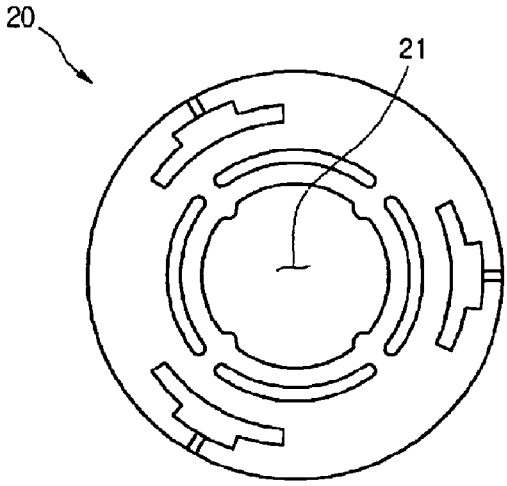

[Fig. 3]
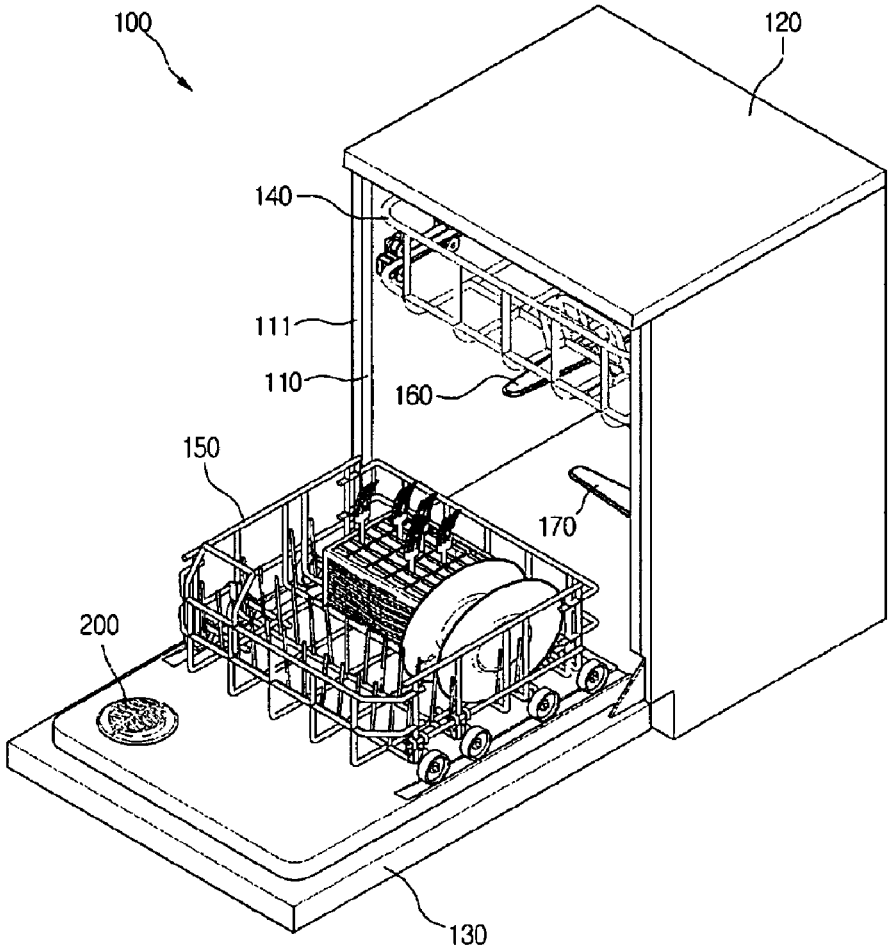
[Fig. 4]
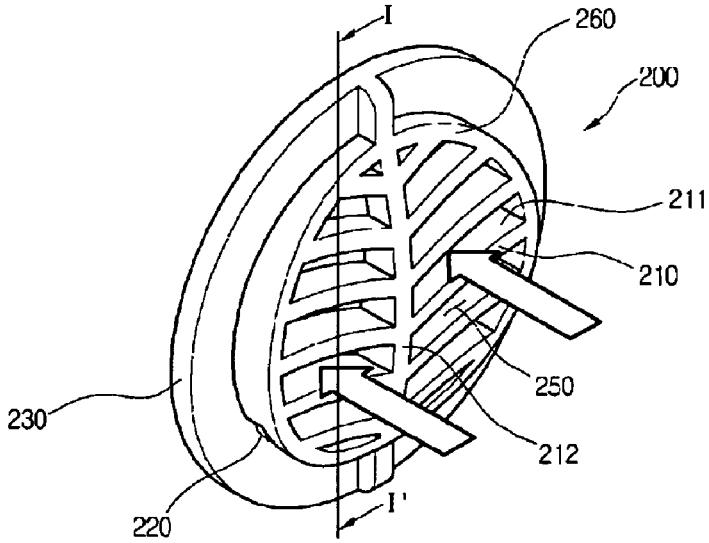

[Fig. 5]
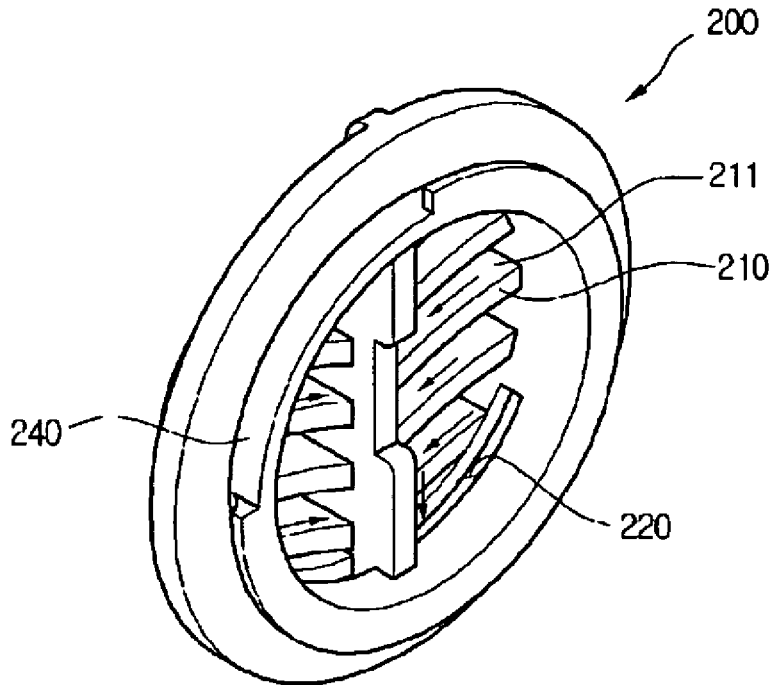
[Fig. 6]
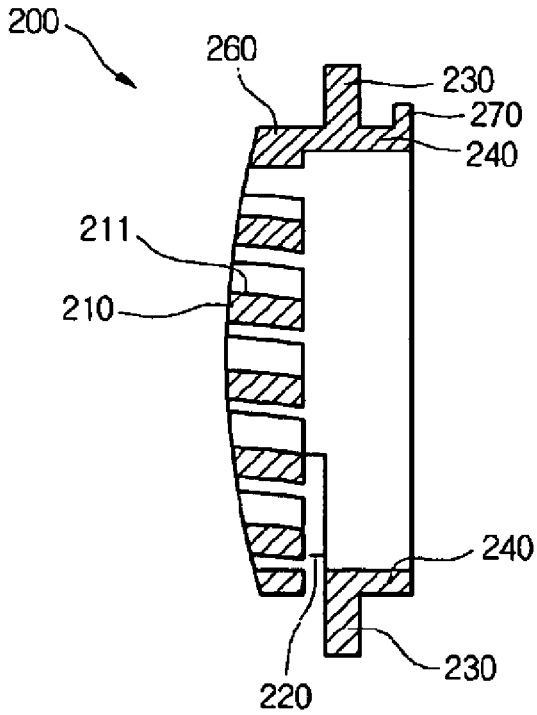

DISH WASHER AND BLOWER COVER THEREOF

This application claims priority to International application No. PCT/KR2005/002586 filed on Aug. 9, 2005, Korean Application No. 10-2004-64197 filed on Aug. 16, 2004, both of which are incorporated by reference, as if fully set forth herein.

TECHNICAL FIELD

The present invention relates to a dishwasher, and more particularly, to a blower cover assembly of a dishwasher, which can prevent water from infiltrating into a steam exhaust system mounted on a door of the dishwasher.

BACKGROUND ART

Generally, a dishwasher is one of electronic appliances, which can wash dishes by removing garbage from the dishes using water sprayed through a spraying nozzle.

FIG. 1 shows a steam exhaust system of a typical dishwasher and FIG. 2 shows a typical blower cover assembly.

Referring to FIGS. 1 and 2, a typical dishwasher includes a tub 11 in which the dishes are received and washed, a door 12 formed on the tub 11 to open and close the tub 11, a blower fan 13 mounted in the door 12 to exhaust hot air our of the tub 11, and a blower cover assembly 20 mounted on an inner circumference of the door 12 in rear of the blower fan 13.

The dishwasher 10 further includes an air outlet in which the blower fan 13 is installed and an air intake 16 formed on a side portion of the tub 11 to introduce hot air into the tub 11. Racks 15 on which dishes 17 will be loaded is formed in the tub 11.

In a drying process, after a rinsing process is finished, outer air is introduced into the tub 11 through the air intake 16. The introduced air passes while colliding with the dishes 17, after which the air is exhausted through the air outlet 14 by the blower fan 13. The introduced air absorbs moisture adhered to the dishes 17 to dry the dishes 17.

In a washing process, a portion of the washing water may be splashed to infiltrate into the blower cover assembly 20 and directed into a steam exhaust system in which a control unit (not shown) for controlling the operation of the blower fan 14. The washing water directed into the steam exhaust system may cause a short circuit or malfunction of the steam exhaust system.

DISCLOSURE OF INVENTION

Technical Problem

Therefore, the present invention has been made in an effort to solve the above-described problems of the typical dishwasher.

It is an object of the present invention to provide a blower cover assembly that is designed to direct washing water, which is being splashed toward a steam outlet, to a bottom of the tub by improving a shape of the steam outlet.

It is another object of the present invention to provide a dishwasher having such a blower cover assembly.

Technical Solution

To achieve the above object, the present invention provides a blower cover assembly of a dishwasher, comprising: an attaching cap contacting a door liner; a guide sleeve extending frontward from the attaching cap; and a guide rib formed on an inner circumference to guide flow of washing water.

According to another aspect of the present invention, there is provided a dishwasher comprising: a tub; a door pivotally mounted on a front portion of the tub; and a blower cover assembly mounted in the door, the blower cap assembly comprising a circular attaching cap, a guide sleeve extending from a front portion of the attaching cap, a guide rib formed on an inner circumference of the guide sleeve, and a cap body extending from a rear surface of the attaching cap.

According to still another aspect of the present invention, there is provided a dishwasher comprising: a tub; a door pivotally mounted on a front portion of the tub, the door comprising a door cover and a door liner mounted on a rear surface of the door cover; a blower cover assembly comprising a circular attaching cap contacting the door liner, a cylindrical cap boy extending from one side of the attaching cap and inserted into the door liner, a guide sleeve extending from another side of the attaching cap and provided with a drain hole, a guide rib formed on an inner circumference of the guide sleeve and inclined in a direction; and a rack formed in the tub to receive dishes.

Advantageous Effects

According to a blower cover assembly of the present invention, since the infiltration of the water into the steam exhaust system can be prevented, the electrical malfunction can be prevented.

BRIEF DESCRIPTION OF THE DRAWINGS

FIG. 1 is a side sectional view of a steam exhaust system of a prior dishwasher;

FIG. 2 is a front view of a prior blower cover assembly;

FIG. 3 is a schematic perspective view of a dishwasher with a blower cover assembly according to an embodiment of the present invention;

FIG. 4 is a front perspective view of a blower cover assembly depicted in FIG. 3;

FIG. 5 is a rear perspective view of a blower cover assembly depicted in FIG. 3; and FIG. 6 is a side sectional view taken along line I-I' of FIG. 4.

BEST MODE FOR CARRYING OUT THE INVENTION

Reference will now be made in detail to the preferred embodiments of the present invention. It is to be understood that the following detailed description of the present invention does not limit the present invention but various modifications and variations can be made in the present invention. Thus, it is intended that the present invention covers the modifications and variations of this invention provided they come within the scope of the present invention.

FIG. 3 is a schematic perspective view of a dishwasher with a blower cover assembly according to an embodiment of the present invention.

Referring to FIG. 3, the inventive dishwasher 100 includes a cabinet 111 defining an outer appearance of the dishwasher 100, a tub 110 provided in the cabinet 111 to define a washing space, a top cover disposed on the tub 110, a door 130 pivotally coupled to a front portion of the tub 110, and a blower cover assembly 200 mounted on the door 130 to exhaust steam out of the tub 110.

The dishwasher 100 further includes upper and lower racks 140 and 150 formed in the tub 111 to receive dishes, a spoon basket 200 disposed on one of the upper and lower racks 140 and 150 to receive spoons, chopsticks and the like, an upper nozzle 160 spraying washing water toward the upper rack 140, and a lower nozzle 170 spraying the washing water toward the lower rack 150.

In operation, after the dishes are loaded on the upper and lower racks 140 and 150 and the spoons and chopsticks are received in the spoon basket 200, the door 130 is closed. Then, the washing mode is inputted and the operation button is pushed.

When the washing process is finished, the washing water is drained out of the tub 110 and new washing water is supplied to the tub 110 to perform the rinsing process. After the rinsing process is finished, the drying process is performed by supplying dry air into the tub 110. The air absorbing moisture from the dishes are exhausted through a steam outlet.

FIG. 4 is a front perspective view of a blower cover assembly depicted in FIG. 3, FIG. 5 is a rear perspective view of a blower cover assembly depicted in FIG. 3, and FIG. 6 is a side sectional view taken along line I-I' of FIG. 4.

Referring to FIGS. 4 through 6, the blower cover assembly 200 is mounted on an upper portion of an inner circumference of the door 130.

The blower cover assembly 200 includes a door liner attaching cap 230 and a guide sleeve 260 extending from an inner portion of the door liner attaching cap 230. The door 130 includes a door cover and a door liner coupled to an inner portion of the door cover.

The door liner attaching cap 230 is fitted in a hole formed on the door liner such that a top surface thereof is exposed. The guide sleeve 210 formed in the door liner attaching cap 230. The guide sleeve 260 includes a center rib 212 vertically crossing the center portion and steam guide ribs 210 connecting an inner circumference of the guide sleeve 260 to the center rib 212. Here, the steam guide ribs 260 are arranged in a comb shape. Each of the steam guide ribs 210 has a first end connected to the inner circumference of the guide sleeve 260 and a second end connected to the center rib 212. The steam guide rib 210 is curved downward as it goes toward the center rib 212. That is, when the steam guide rib 210 is formed in a V-shape when showing a front portion of he steam exhaust cover 200.

In addition, the steam outlet holes 250 are formed between the steam guide ribs 210. The air used in the drying process is exhausted through the steam outlet holes 250. That is, the steam guide ribs 210 are inclined downward at they go rearward. Therefore, the washing water splashed into the steam outlet holes 250 flows downward along top surfaces of the steam guide ribs 210.

The blower cover assembly 200 is further provided with a washing water dropping hole 220 formed on a lower portion of the guide sleeve 260. Therefore, the washing water flowing along the top surfaces 211 of the steam guide sleeve 260 is returned to the inner bottom of the tub 110 through the washing water dropping hole 220.

Referring to FIG. 5, a cap body 240 is formed on a rear surface of the door liner attaching cap 230, having a diameter identical to that of the guide sleeve 260. A locking rib 270 is formed extending in a radial direction from an end of the cap body 240. The locking rib 270 may be formed on all or part of the outer circumference of the cap body 240. Therefore, in order to mount the blower cover assembly on the inner circumference of the door, the cap body 240 is inserted into a hole formed on the door liner until a rear surface of the door liner attaching cap 230 closely contacts a surface of the door liner. Then, when the blower cover assembly 200 rotates, the blower cover assembly 200 securely fixed on the door liner by the locking rib 270.

*The operation of the blower cover assembly 200 will be described hereinafter.

When the dishwasher operating button is pushed, the washing water is spraying through the spraying nozzles to remove waste from the dishes. At this point, a portion of the washing water may be splashed toward the blower cover assembly 200 by colliding with the dishes. The splashed water to the blower cover assembly 200 may be introduced into the steam exhaust system through the steam outlet hole 250. At this point, since the washing water guide ribs 210 are inclined downward, the washing water introduced through the steam outlet hole 250 collides with bottom surfaces of the washing water guide ribs 210 and falls down to the top surfaces of the washing water guide ribs 210.

Since the washing water guide ribs 210 are inclined toward the center rib 212, the washing water on the top surface of the washing water guide ribs 210 flows to the center rib 212 and drops downs on the bottom of the tub 110 through the washing water dropping hole 220.

Therefore, the washing water that is directed toward the blower cover assembly 200 during the washing process is not infiltrated into the steam exhaust system, thereby preventing the short circuit and the damage of the components of the steam exhaust system.

INDUSTRIAL APPLICABILITY

According to the inventive blower cover assembly, since the splashed washing water does not cause the malfunction of the components, the industrial applicability thereof is very high.

The invention claimed is:

1. A dishwasher comprising:

a tub;

a door pivotally mounted on a front portion of the tub, the door comprising a door cover and a door liner mounted on a rear surface of the door cover; and a blower cover assembly comprising:

a circular attaching cap inserted in a hole formed on the door liner;

a guide sleeve extending frontward from the attaching cap and having a diameter less than a diameter of the attaching cap;

a guide rib formed on an inner circumference to guide flow of washing water; and a dropping hole formed on a lower portion of the guide sleeve for dropping the washing water to the tub.

2. The blower cover assembly according to claim 1, wherein the guide rib is formed in a V-shape.

3. The blower cover assembly according to claim 1, wherein a center rib is formed on the inner circumference of the guide sleeve while dividing the guide rib in equal two parts.

4. The blower cover assembly according to claim 1, wherein the guide rib has front and rear ends in which the front end is higher than the rear end.

5. The blower cover assembly according to claim 1, further comprising a cap body extending from a rear surface of the attaching cap and a locking rib extending in a radial direction from an end of the cap body.

6. The dishwasher according to claim 5, wherein the cap body has a diameter substantially identical to that of the guide sleeve.

* * * * *